US010596848B2

(12) United States Patent
Ojan et al.

(10) Patent No.: US 10,596,848 B2
(45) Date of Patent: Mar. 24, 2020

(54) MOISTURE PAD

(71) Applicant: Sahar Dawn Ojan, Warminster, PA (US)

(72) Inventors: Sahar Dawn Ojan, Warminster, PA (US); Craig Anthony Hidalgo, Langhorne, PA (US)

(73) Assignee: Sahar Dawn Ojan, Warminster, PA (US)

( * ) Notice: Subject to any disclaimer, the term of this patent is extended or adjusted under 35 U.S.C. 154(b) by 0 days.

(21) Appl. No.: 16/034,298

(22) Filed: Jul. 12, 2018

(65) Prior Publication Data

US 2020/0016921 A1 Jan. 16, 2020

(51) Int. Cl.

*B43M 11/04* (2006.01)
*B43M 11/00* (2006.01)
*B05C 17/005* (2006.01)

(52) U.S. Cl.

CPC ..... *B43M 11/04* (2013.01); *B05C 17/00569* (2013.01); *B43M 11/00* (2013.01)

(58) Field of Classification Search

CPC ..... B43M 11/04; B43M 11/00; B43M 11/06; B43M 5/00; B43M 5/02; B43M 5/025; A45D 2200/1009; A45D 2200/1018; A47L 13/16; A47L 13/17; B05C 17/00569; B05C 17/00583

See application file for complete search history.

(56) References Cited

U.S. PATENT DOCUMENTS

| | | | | |
|---|---|---|---|---|
| 1,467,040 | A | 9/1923 | Jerabek et al. | |
| 1,949,865 | A | 3/1934 | Horton | |
| 2,554,302 | A | 5/1951 | Keskitalo | |
| 2,658,474 | A | 11/1953 | Sengbusch | |
| 2,741,219 | A | 4/1956 | Montalcini | |
| 2,876,735 | A | 3/1959 | Link | |
| 2,932,277 | A | 4/1960 | Borah | |
| 3,082,736 | A | 3/1963 | Waters | |
| 4,159,883 | A | 7/1979 | Mizell | |
| 5,341,538 | A | 8/1994 | Banome | |
| 5,433,782 | A | 7/1995 | Filbert et al. | |
| 5,704,723 | A | 1/1998 | Salisian | |
| 6,412,997 | B2 * | 7/2002 | Berke | A45D 34/04 401/138 |
| 6,726,385 | B1 * | 4/2004 | Borowski | A46B 9/005 401/187 |
| 7,004,659 | B1 * | 2/2006 | Goodman | B05C 17/002 222/633 |
| 9,717,375 | B2 * | 8/2017 | Pelfrey | A47K 5/1208 |
| 10,343,447 | B2 * | 7/2019 | Ojan | |

(Continued)

*Primary Examiner* — David J Walczak

(74) *Attorney, Agent, or Firm* — Ojan IP LLC; Ourmazd S. Ojan

(57) ABSTRACT

A moisture pad includes a porous pad, for example a sponge, and a container divided into a water reservoir and a compartment for securely supporting the porous pad. The reservoir has a filling opening provided with a closure. The closure includes a flexible dome that can be pressed to pressurize the contents of the reservoir. One-way valves regulate the flow of fluids between the reservoir and the porous pad compartment. Optionally, a lid may be provided as a closure for the container to reduce evaporation of the water. As another option, a strap can be provided for the container to allow the moisture pad to be worn on a person's body.

18 Claims, 24 Drawing Sheets

(56) References Cited

U.S. PATENT DOCUMENTS

| | | | |
|---|---|---|---|
| 2003/0202838 | A1 | 10/2003 | Sun et al. |
| 2012/0060862 | A1 | 3/2012 | Van Tran |
| 2017/0197456 | A1 | 7/2017 | Ojan |

* cited by examiner

MOISTURE PAD

BACKGROUND OF THE INVENTION

1. Field of the Invention

The present invention relates to a moisture pad for wetting one's fingers for a better grip or for moistening the adhesive of an envelope flap or the like.

2. Description of the Prior Art

People find that moistening their fingers affords them a better grip when handling sheets of material such as paper or plastic, allowing them to more easily separate sheets of such materials. For example, when turning the pages of a book or counting paper money, people are commonly observed moistening their fingers with their saliva to allow them to more easily separate the sheets of paper. The same technique is also applied when opening plastic bags at the grocery store. However, such practices are unhygienic, and many people that may have to handle an item, after it is handled by a person who moistened their fingers with their saliva, find such practices objectionable.

Moist sponges placed in open containers are often placed on post office counters for patrons to use for moistening the flaps of the envelopes to activate the pre-applied adhesive. Also, tubes of fluid adhesives with sponge applicators at the tips are known for the purpose of activating the pre-applied adhesive of the flaps of the envelopes. However, these fluid adhesives leave a tacky residue that makes them unsuitable for moistening fingers, and the open containers with wet sponges cannot be conveniently carried on a person as they go about their daily activities. The need persists for a device that allows a person to moisten their fingers in a more hygienic manner and that can be conveniently carried on a person as they go about their daily activities.

SUMMARY OF THE INVENTION

The present invention is directed to a moisture pad that is easily portable. The moisture pad includes a container or housing divided into a water reservoir and a compartment for a porous pad, for example a sponge; a porous pad housed within the porous pad compart; and a pump means for transferring water from the reservoir to the sponge or to the compartment housing the sponge. Optionally, a lid may be provided as a closure for the container to reduce evaporation of the water. As another option, a strap can be provided for the container to allow the moisture pad to be worn on a person's body. The strap can, for example, be a wrist strap or an upper arm strap. The reservoir is preferably provided with a closable filling opening. In the illustrated embodiment, the filling opening is provided with a flexible and resilient closure, which can be removed to open the filling opening to allow the reservoir to be filled with water or other suitable fluid and reinstalled to close the filling opening.

The reservoir is provided with a one-way valve that allows water to be dispensed to the porous pad when the flexible closure is pressed to squeeze or compress and thus pressurize the air and water within the reservoir. The one-way valve is normally closed to prevent water loss from the reservoir. The user can press the flexible closure to pressurize the contents of the reservoir and thus open the one-way valve to allow water to be applied to the porous pad as necessary to wet the pas when desired. A second one-way valve allows air to enter the reservoir from the porous pad compartment in order to prevent formation of a vacuum in the reservoir and thus ensure unhindered flow of water from the reservoir to the porous pad compartment when the flexible closure is pressed.

The one-way valves, can be of any suitable type such as, for example, a caged ball one-way valve; a spring biased, caged ball one-way valve; or a flexible flap one-way valve of molded rubber that is self-biased or internally biased to assume the closed configuration. In the illustrated example, a type of flexible flap one-way valve of molded rubber referred to as an umbrella valve is used. U.S. Patent Application Publication No. US 2017/0197456 A1, published on Jul. 13, 2017, in the name of Sahar Dawn Ojan, a joint inventor presently herein, discloses various types of one-way valve useable with the example moisture pads disclosed herein and is incorporated by reference herein in its entirety.

Accordingly, it is an aspect of the present invention to provide a moisture pad comprising:

a container divided into a reservoir and a porous pad compartment, the reservoir having a filling opening;

a closure for the filling opening, the closure incorporating means for pressurizing the reservoir; and a porous pad for holding a quantity of absorbed water, the porous pad being housed in the porous pad compartment, the porous pad wetting one or more of a user's fingers with a portion of a quantity of water absorbed therein when the porous pad having the quantity of water absorbed therein is pressed by the one or more of the user's fingers, wherein the reservoir is for holding a quantity of water, wherein water from the reservoir can be used for wetting the porous pad under the control of the user, wherein the porous pad compartment has a top opening for allowing access to the porous path.

It is another aspect of the present invention to provide a moisture pad in accordance with any of the other aspects of the invention recited herein, wherein the closure is flexible and resilient and can be pressed inward by the user to pressurize the reservoir such that water from the reservoir wets the porous pad when the closure is pressed inward by the user while the reservoir holds at least a predetermined quantity of water.

It is still another aspect of the present invention to provide a moisture pad in accordance with any of the other aspects of the invention recited herein, further comprising one or more one-way valves for controlling water flow to the porous pad compartment.

It is yet another aspect of the present invention to provide a moisture pad in accordance with any of the other aspects of the invention recited herein, wherein the moisture pad further comprises at least a second one-way valve for allowing air to enter the reservoir so as to prevent the creation of a vacuum inside the reservoir.

It is yet another aspect of the present invention to provide a moisture pad in accordance with any of the other aspects of the invention recited herein, further comprising a strap for holding the moisture pad on a person's body.

It is yet another aspect of the present invention to provide a moisture pad in accordance with any of the other aspects of the invention recited herein, wherein the closure has a portion for covering the filling opening, a cylindrical sleeve, and an annular protuberance, wherein the annular protuberance is attached to an end portion of the cylindrical sleeve that is distally located from the portion for covering the filling opening, and wherein when the closure is secured to the filling opening in the closed position, the cylindrical sleeve extends into the filling opening and the annular protuberance engages an inner edge of the filling opening to secure the closure to the filling opening in the closed position.

It is yet another aspect of the present invention to provide a moisture pad in accordance with any of the other aspects of the invention recited herein, wherein the portion for covering the filling opening comprises a central dome surrounded by an annular flange, wherein the dome can be pressed inward toward the reservoir in order to pressurize the reservoir.

It is yet another aspect of the present invention to provide a moisture pad in accordance with any of the other aspects of the invention recited herein, further comprising a closure or lid for the container that covers the top opening for allowing access to the porous pad when the closure or lid for the container is in a closed position.

It is yet another aspect of the present invention to provide a moisture pad in accordance with any of the other aspects of the invention recited herein, wherein the first one-way valve is an umbrella valve.

It is yet another aspect of the present invention to provide a moisture pad in accordance with any of the other aspects of the invention recited herein, wherein the second one-way valve is an umbrella valve.

These and other aspects and advantages of the present invention will be further elucidated by the following Detailed Description, drawing figures, and Claims.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
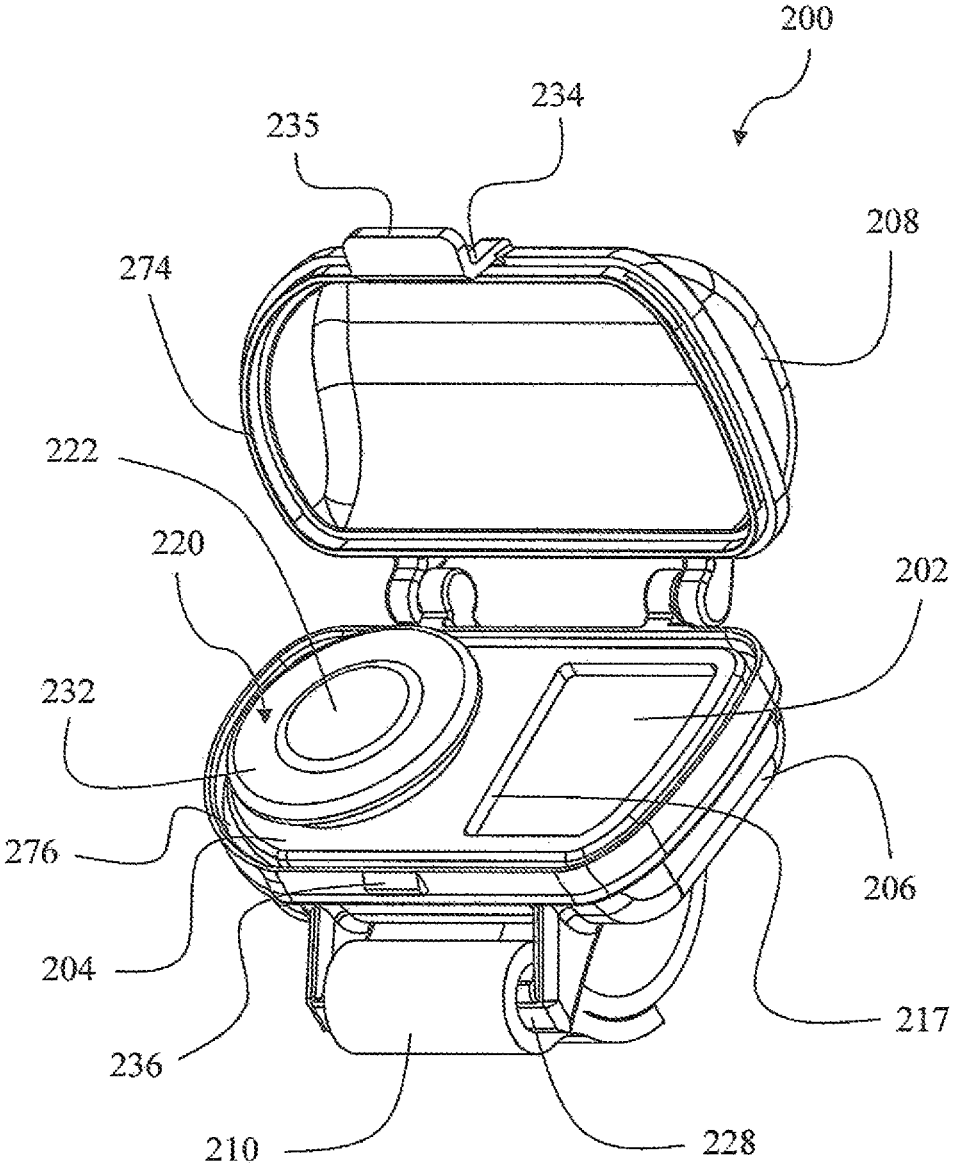
FIGS. 1-7 are views of an illustrative embodiment of the moisture pad according to the present invention shown with the lid open.
Figure 2:
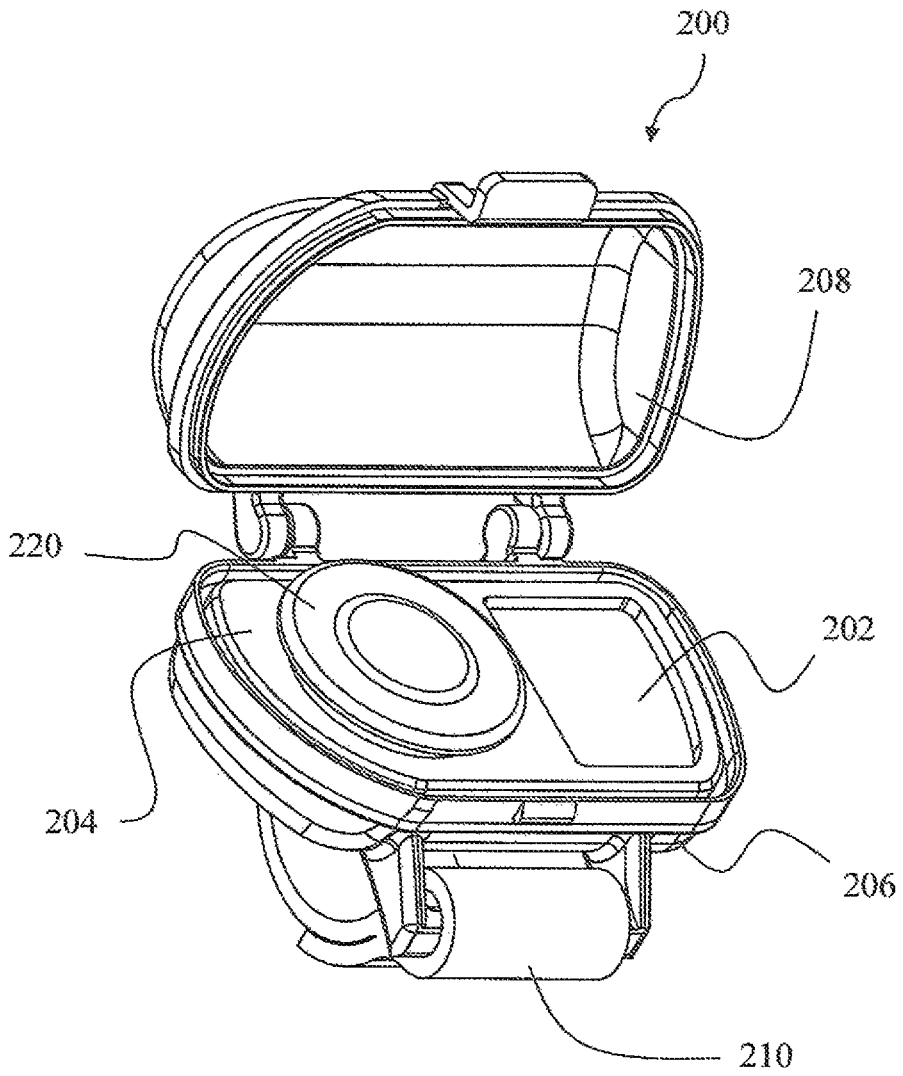
Figure 3:
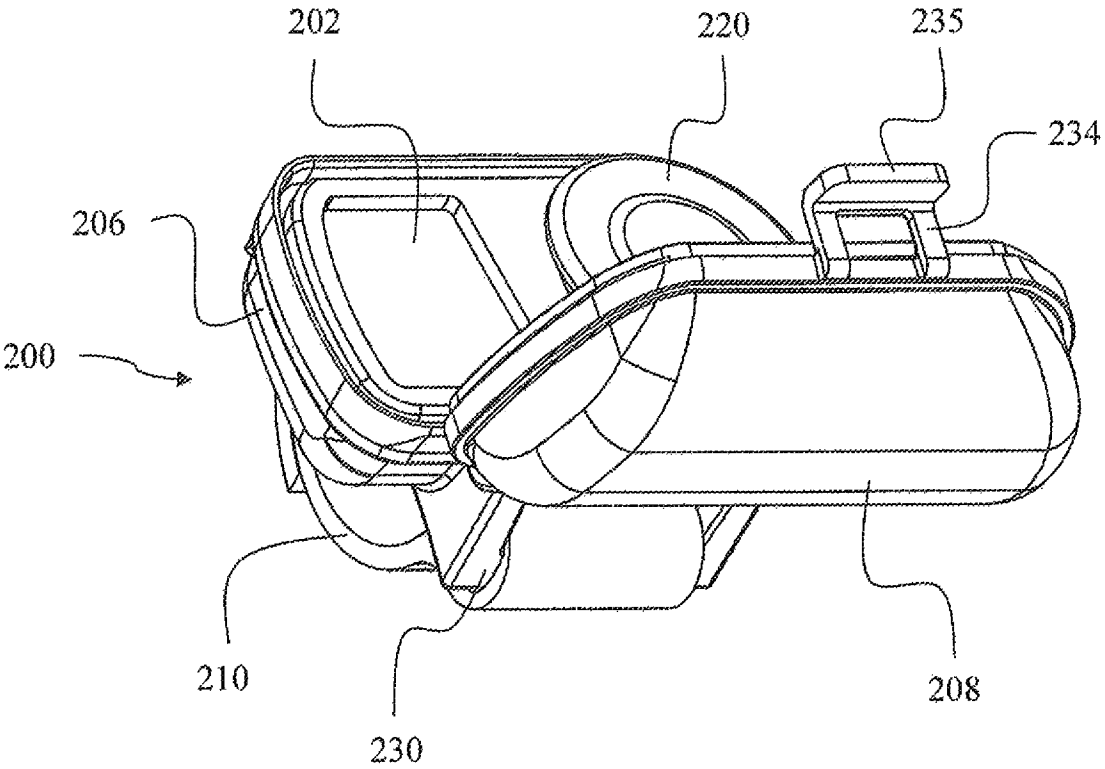
Figure 4:
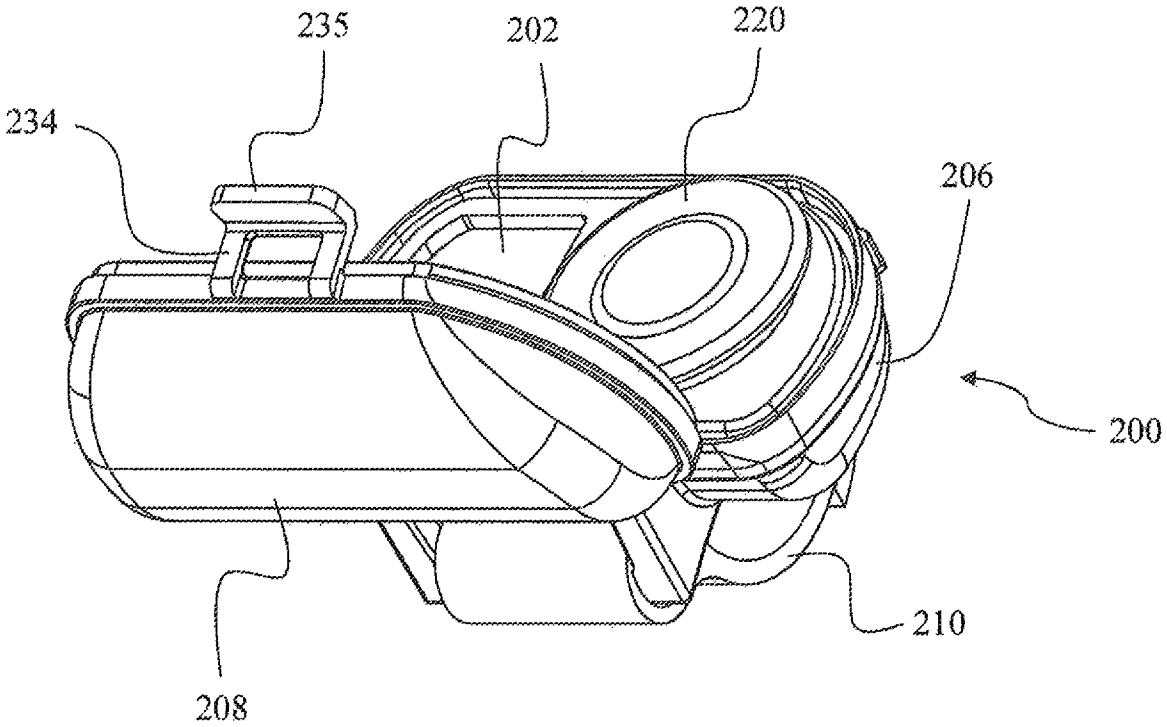
Figure 5:
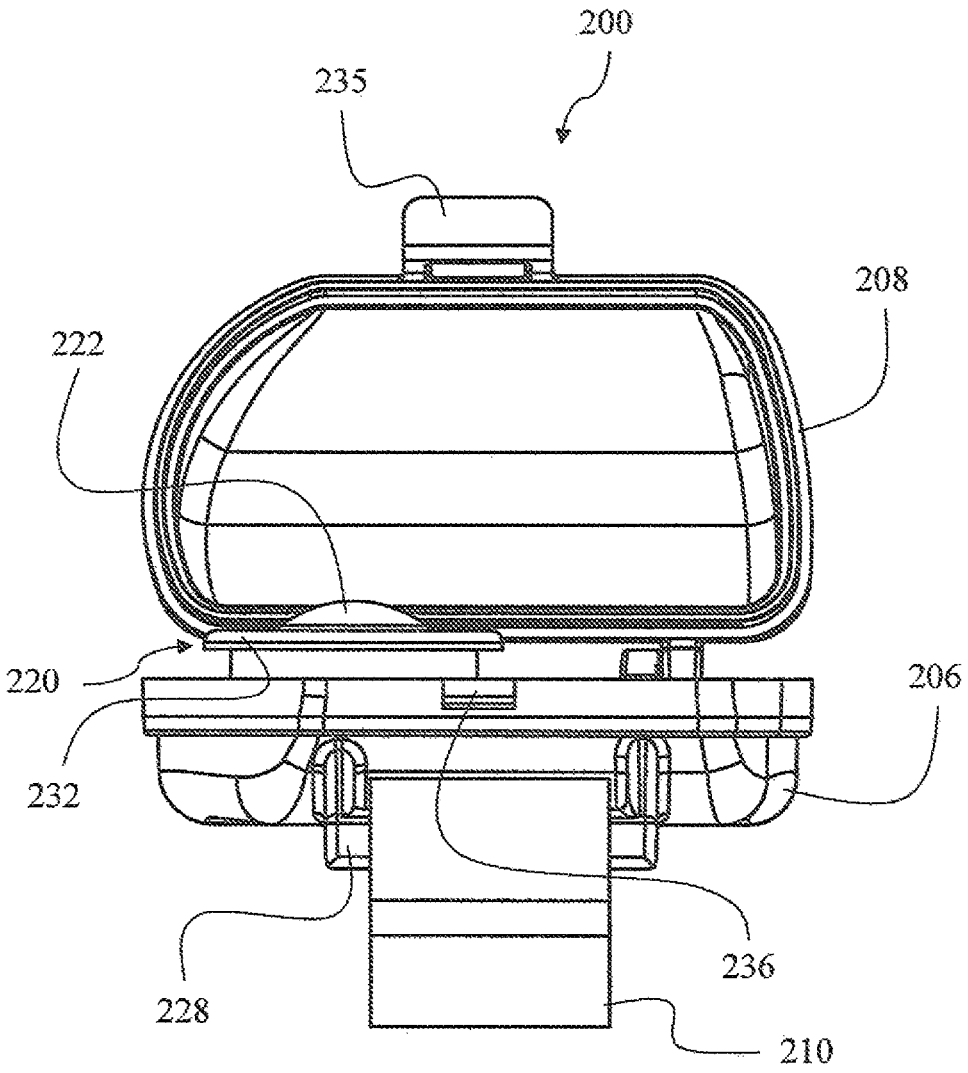
Figure 6:
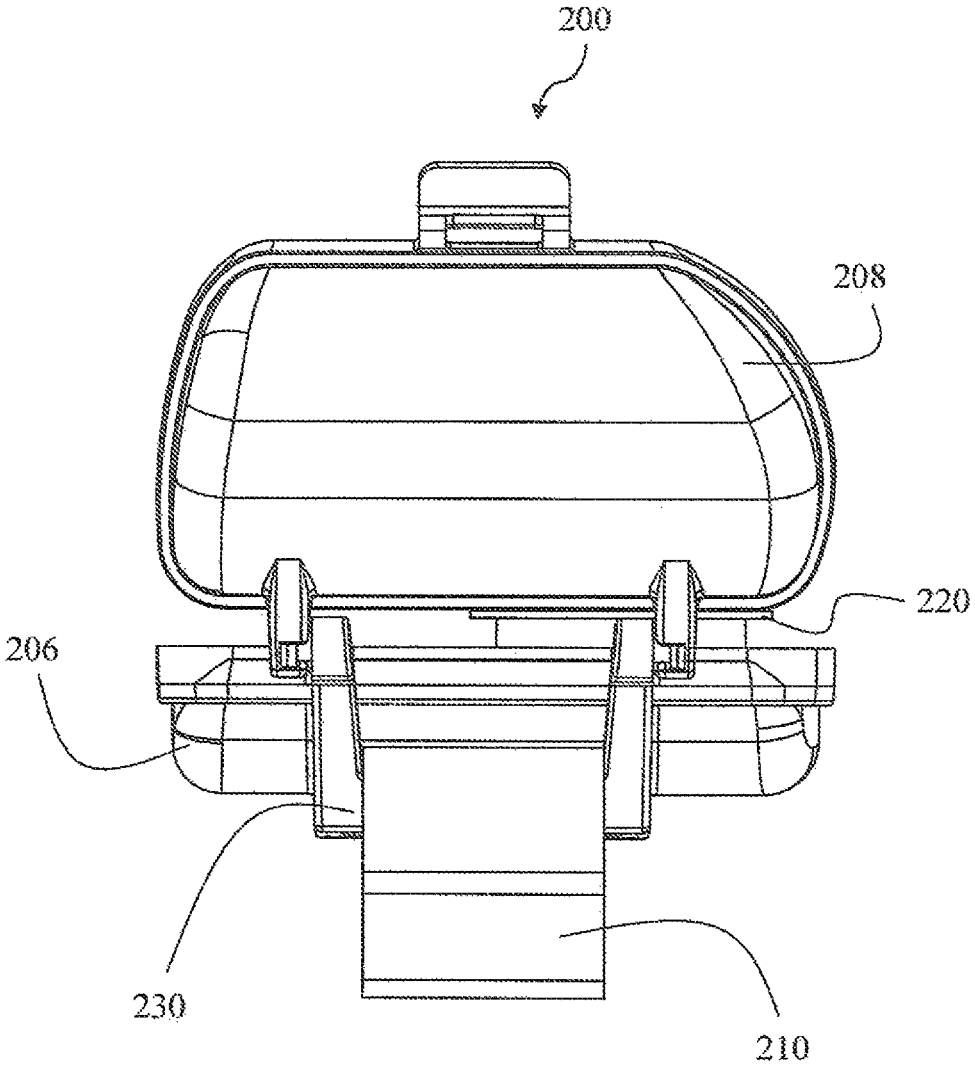
Figure 7:
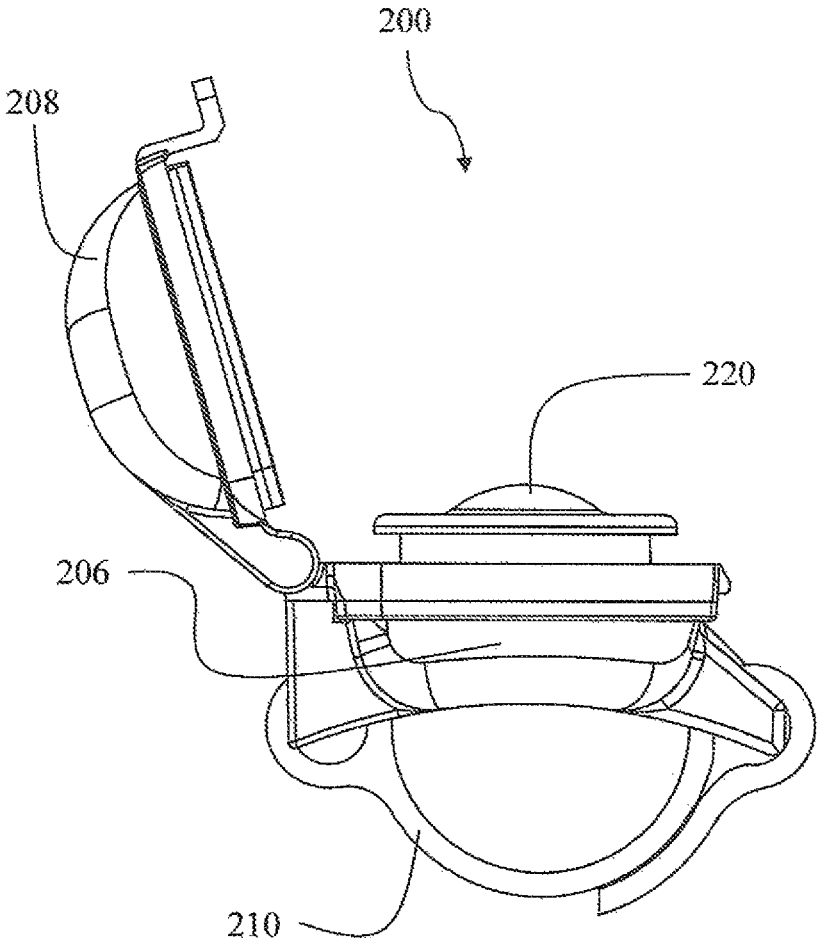
Figure 8:
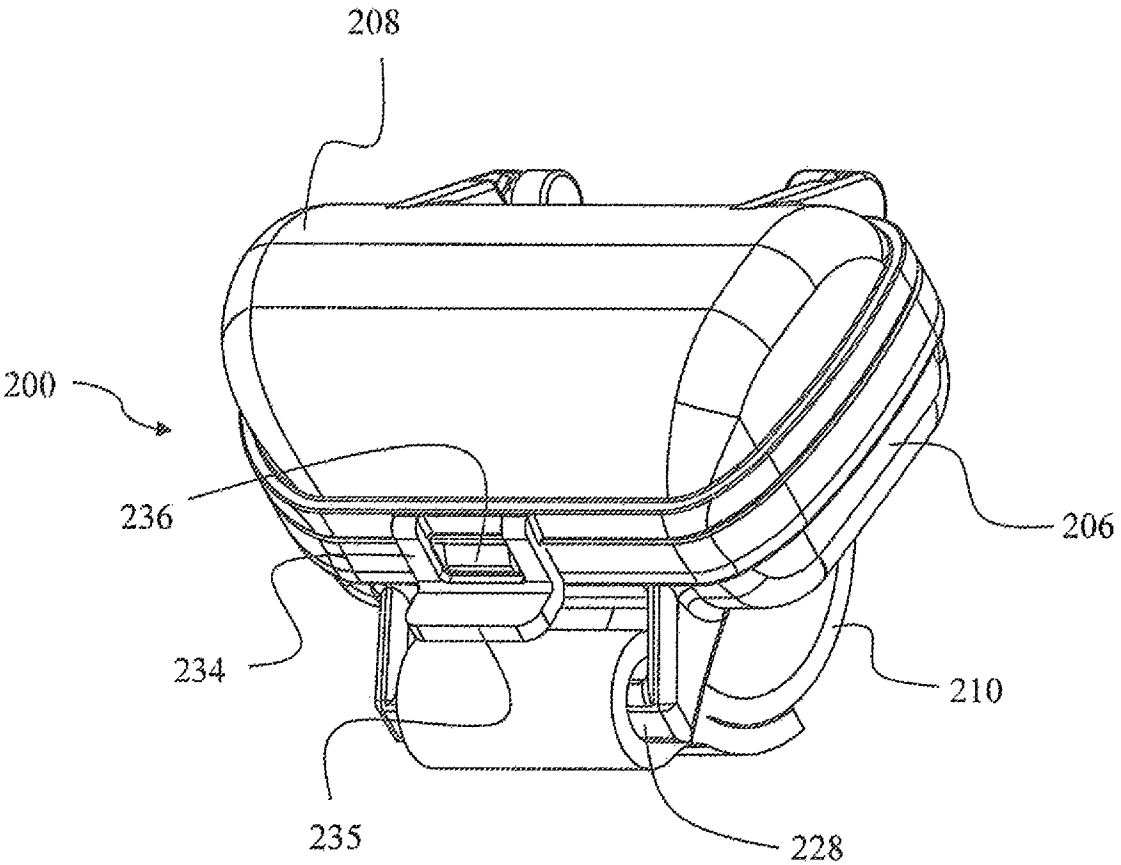
FIGS. 8-14 are views of the illustrative embodiment of the moisture pad according to the present invention shown with the lid closed.
Figure 9:
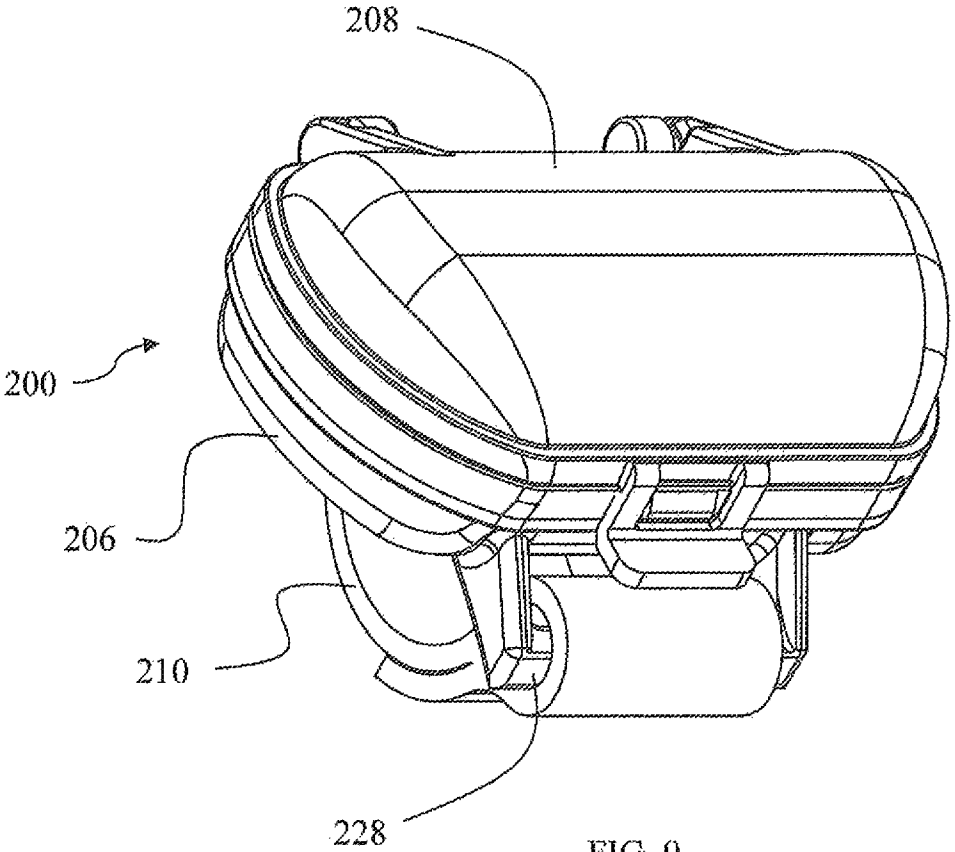
Figure 10:
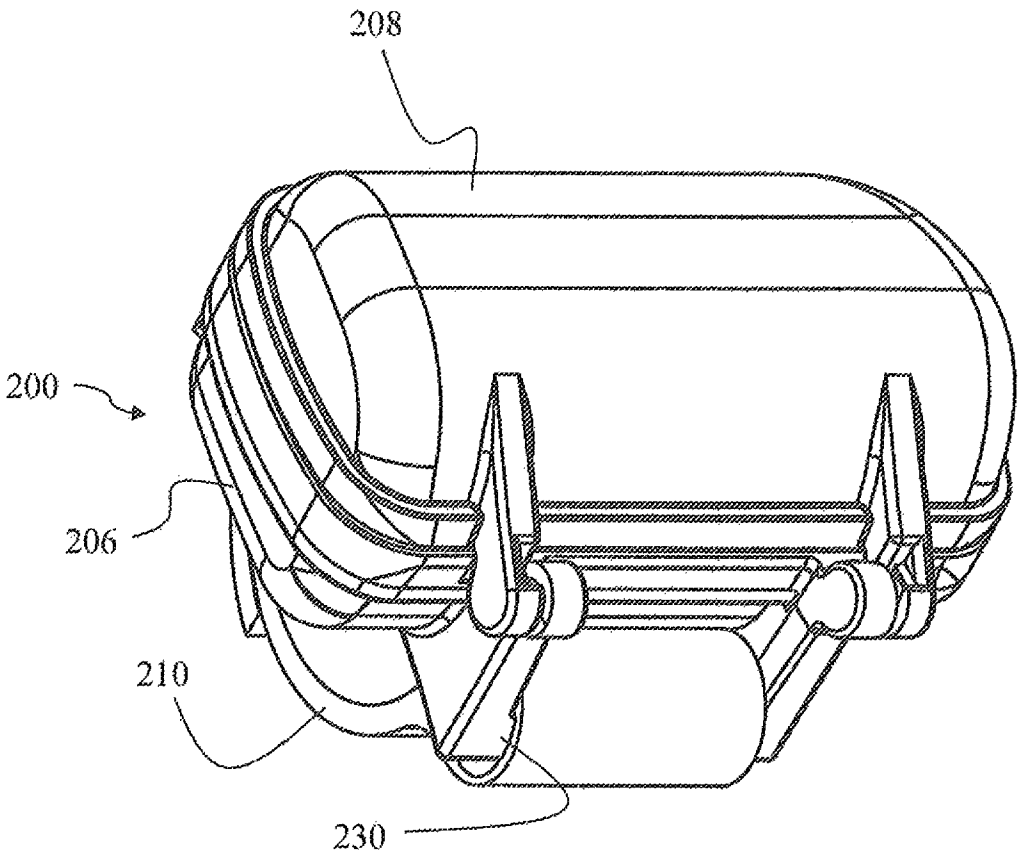
Figure 11:
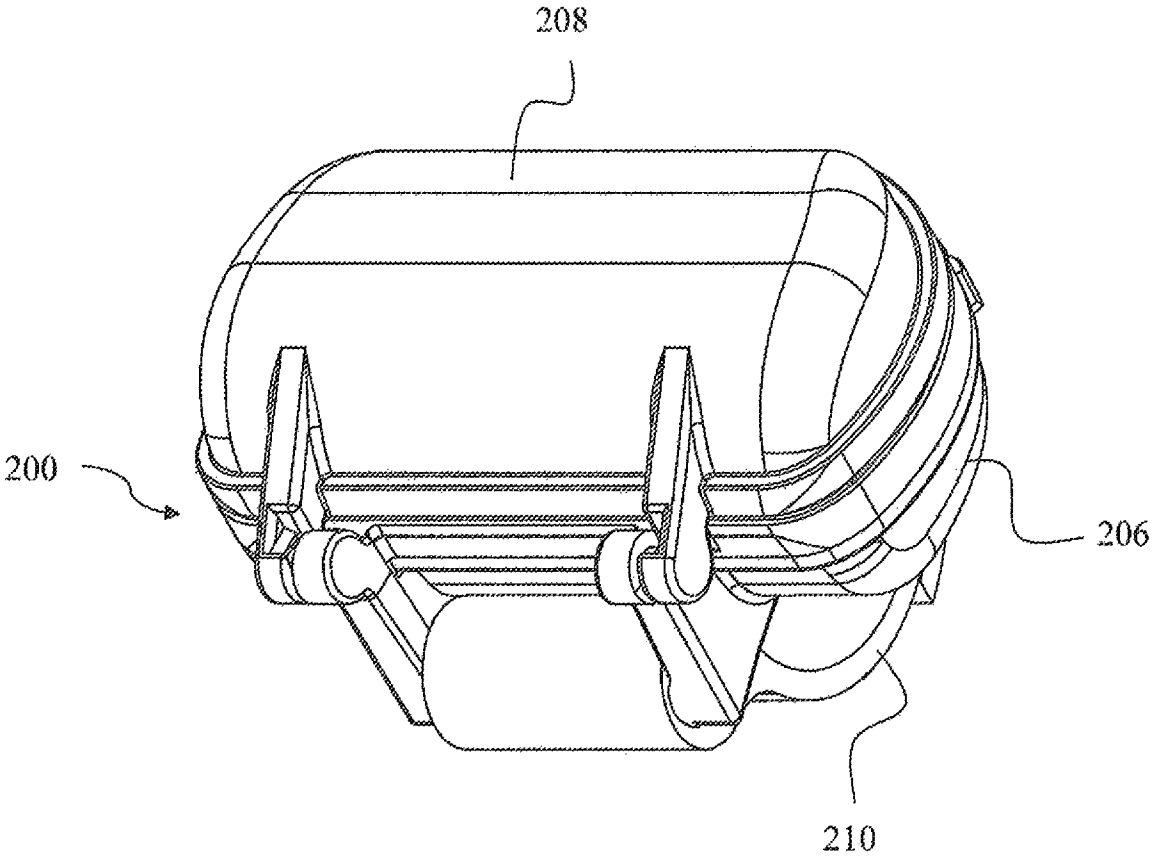
Figure 12:
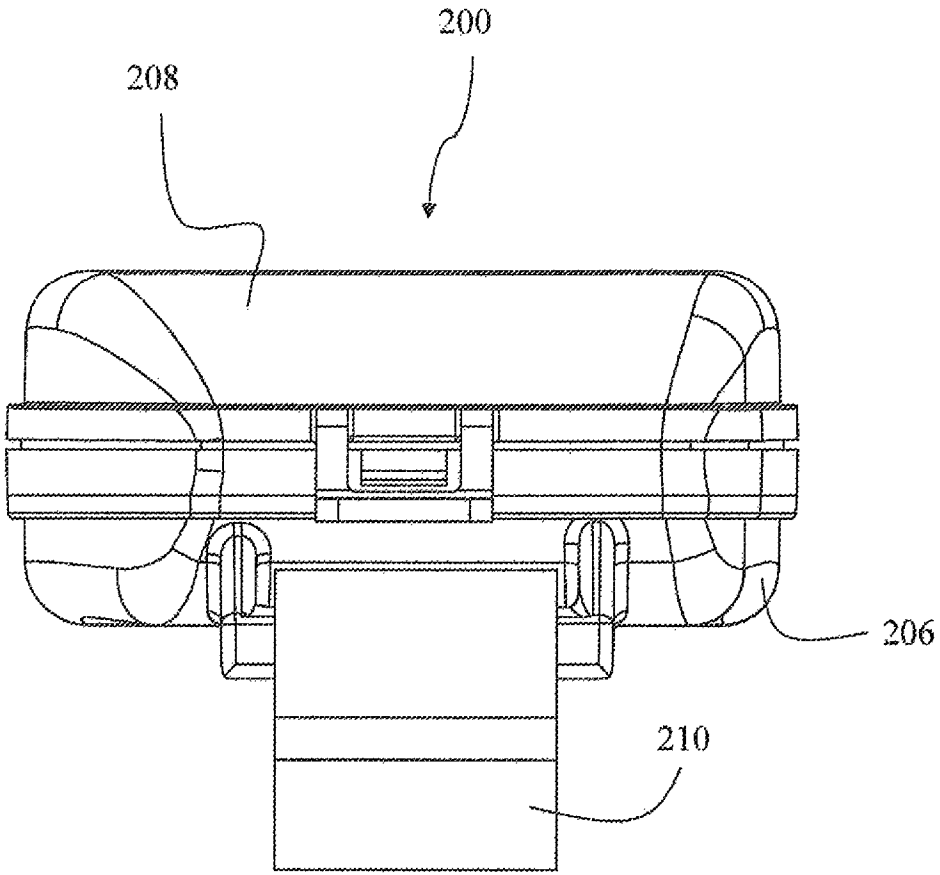
Figure 13:
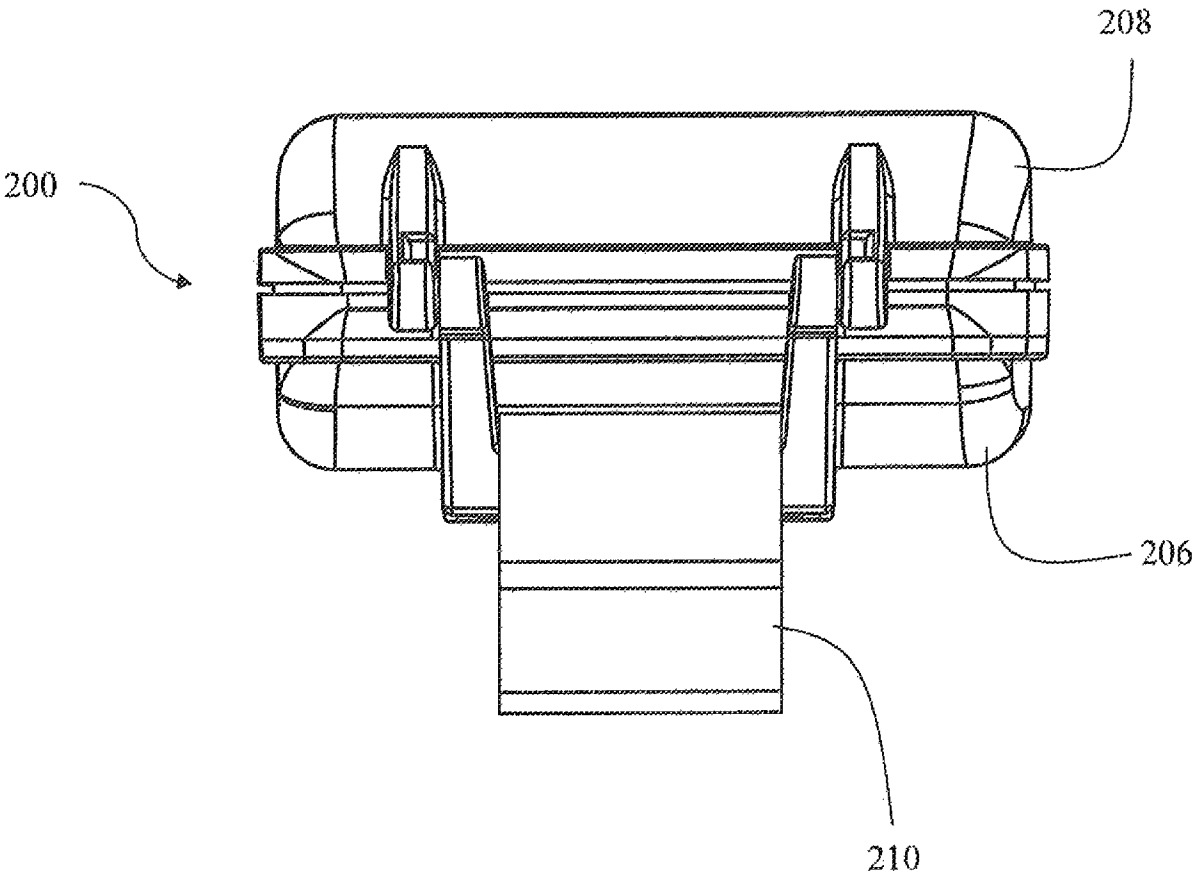
Figure 14:
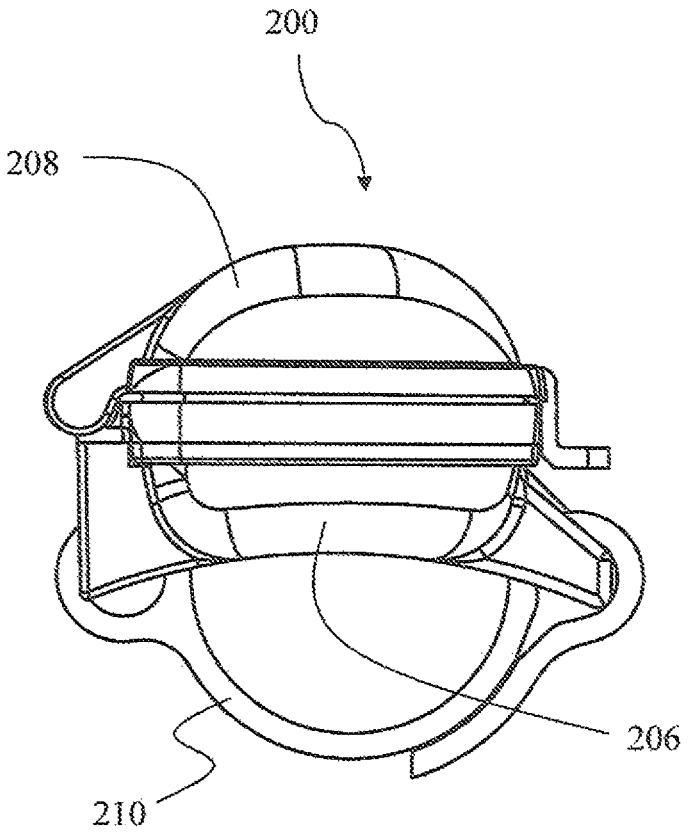
Figure 15:
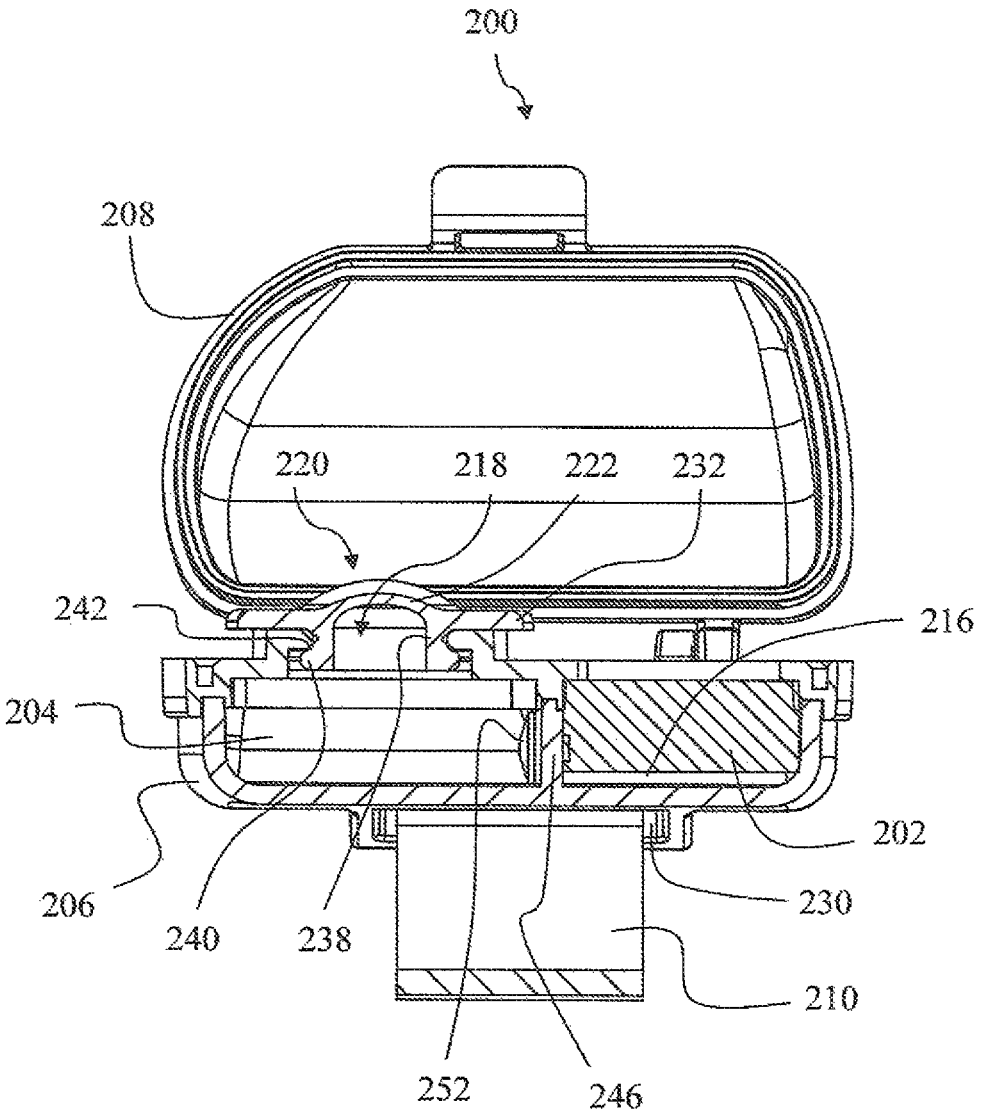
FIGS. 15-16 are cross sectional views of the illustrative embodiment of the moisture pad according to the present invention showing the internal detail.
Figure 16:
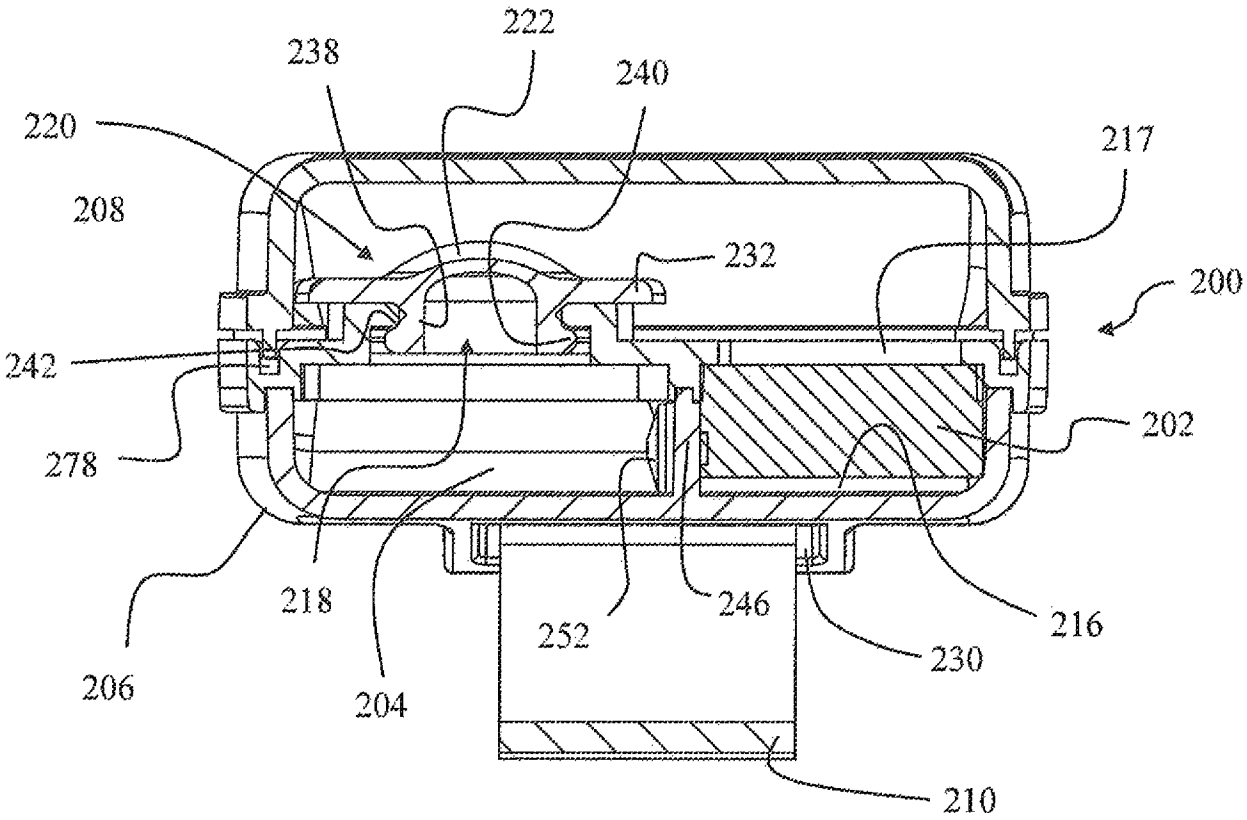
Figure 17:
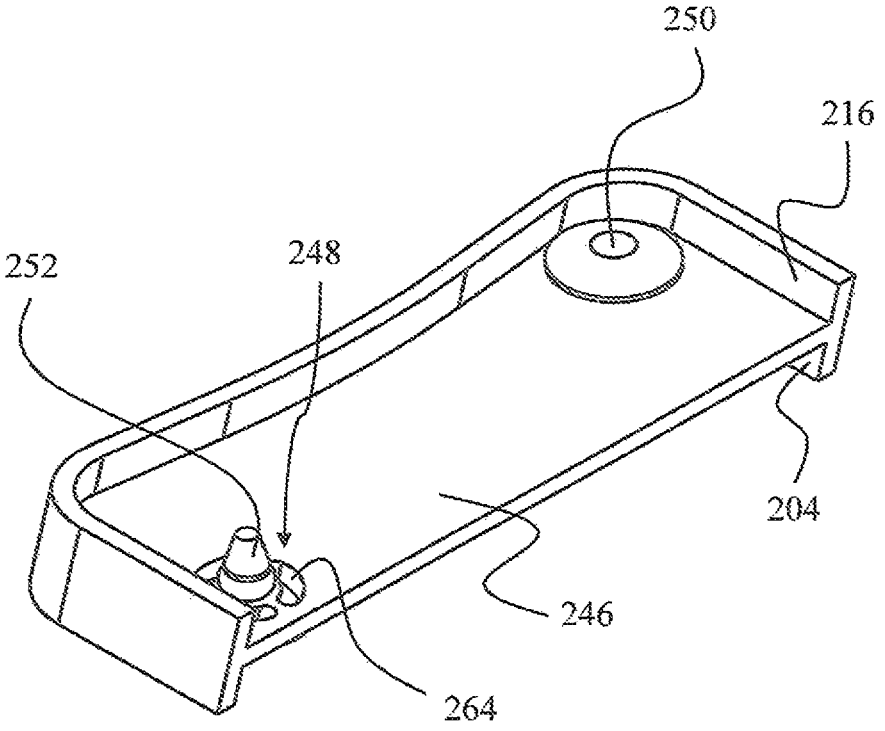
FIGS. 17-19 are fragmentary views that illustrate the one-way valves for controlling water flow to the sponge and air flow into the reservoir.
Figure 18:
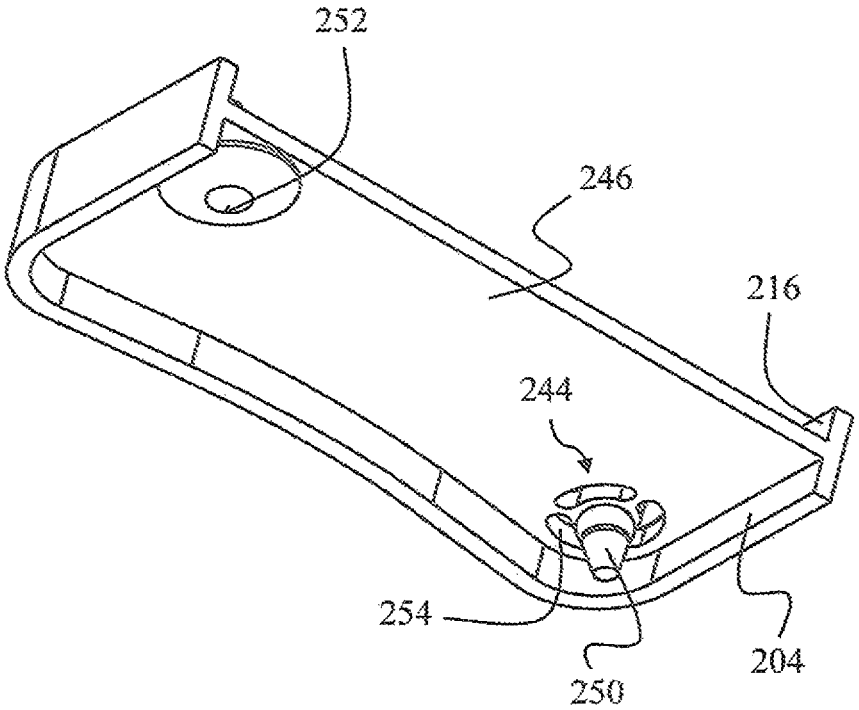
Figure 19:
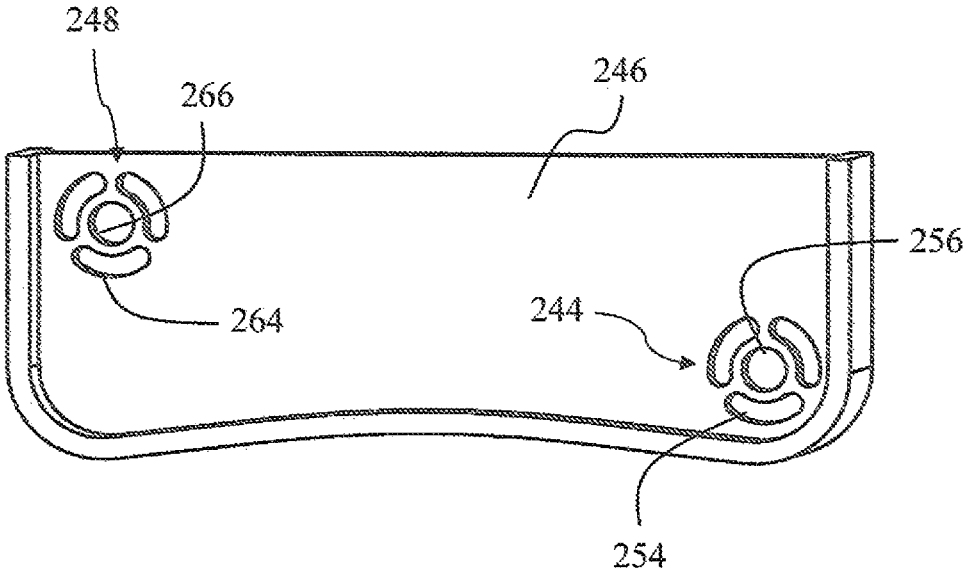
Figure 21:
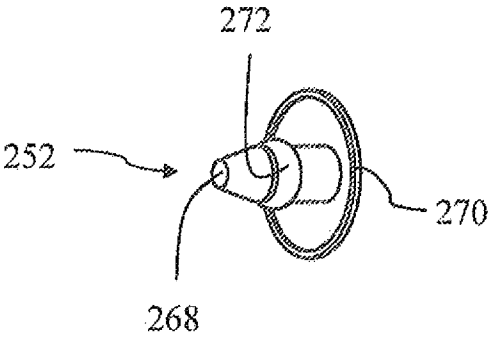
FIGS. 20-23 are views of the isolated umbrella valves used with the illustrative embodiment of the moisture pad according to the present invention showing the structural details of the umbrella valves.
Figure 20:
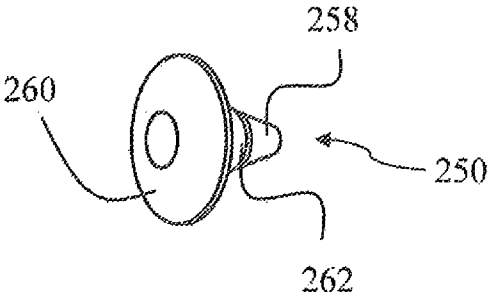
Figure 22:
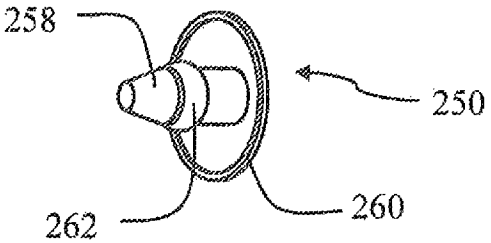
Figure 23:
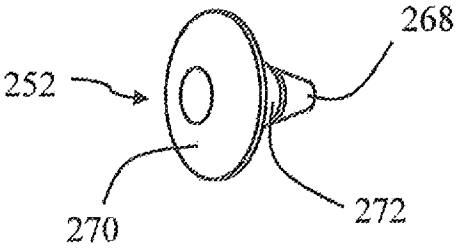
Figure 25:
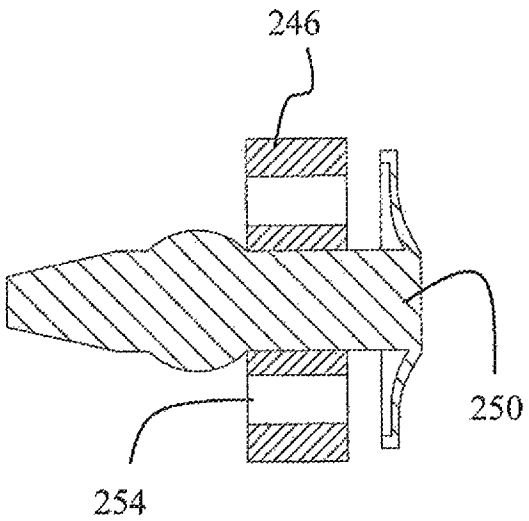
FIGS. 24-25 are cross sectional fragmentary views showing the closed and open configurations, respectively, of the umbrella valve providing one-way flow from the water reservoir to the porous pad compartment.
Figure 24:
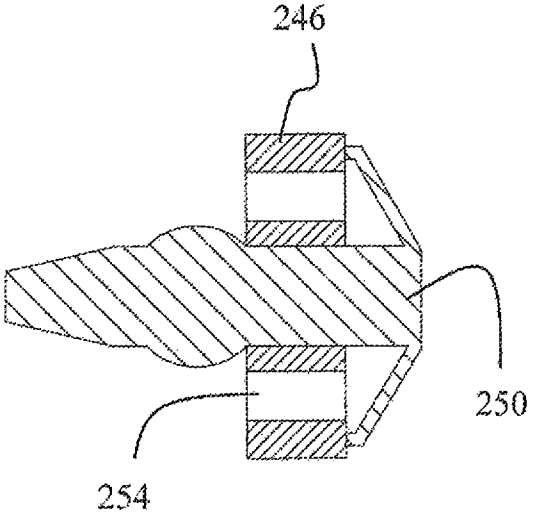
Figure 26:
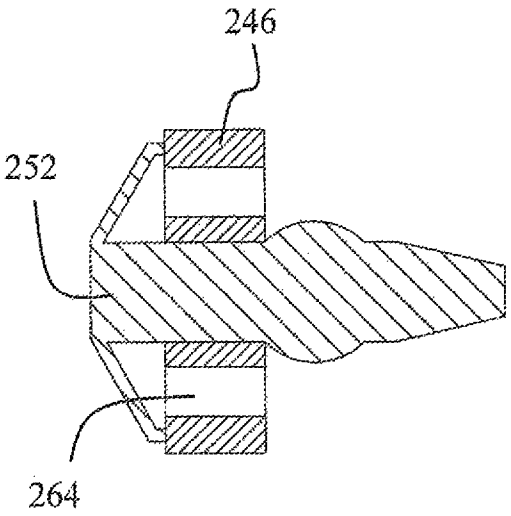
FIGS. 26-27 are cross sectional fragmentary views showing the closed and open configurations, respectively, of the umbrella valve providing one-way flow from the porous pad compartment to the water reservoir.
Figure 27:
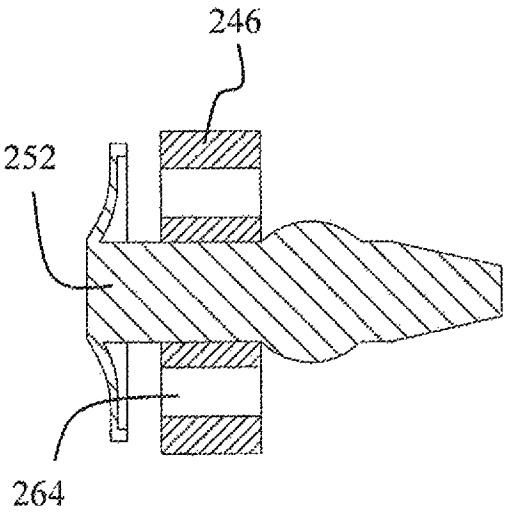
Figure 28:
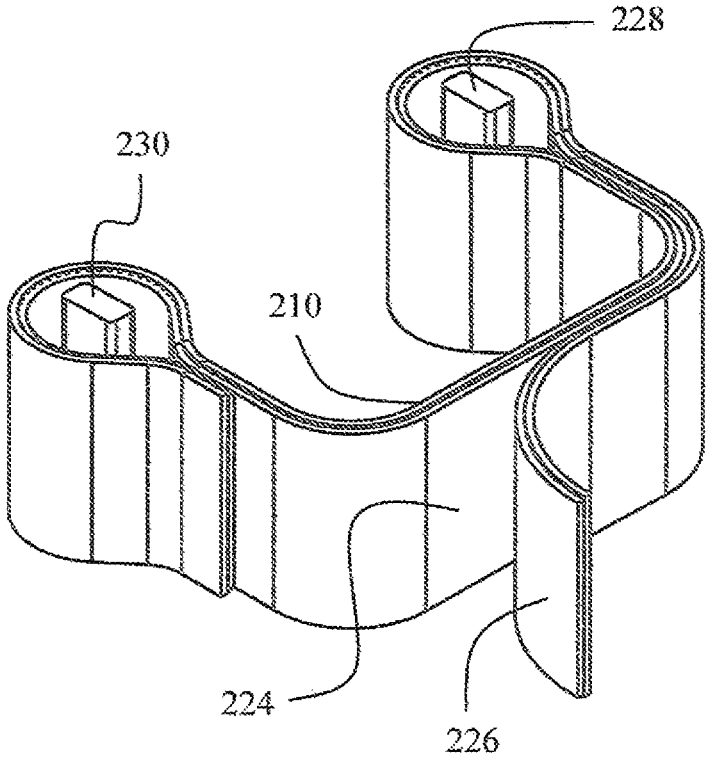
FIG. 28 is a fragmentary view showing the hook and loop fastener portions of the strap used with the illustrative embodiment of the moisture pad according to the present invention.

Referring to FIGS. 1-28, the present invention is directed to a moisture pad 200 that is easily portable. The moisture pad 200 includes a porous pad 202, for example a sponge; a water reservoir 204; and a container 206. The container 206 is divided into two compartments. One compartment forms the reservoir 204 and the second compartment 216 houses the porous pad 202. The porous pad compartment 216 has a top opening 217 for allowing access to the porous pad 202.

Optionally, a lid 208 may be provided as a closure for the container 206 to reduce evaporation of the water. In the illustrated example, the lid 208 is hinged to the container 206. The lid 208 is preferably provided with fastening means to secure the lid 208 to the container 206 in the closed position. The fastening means for releasably securing the lid 208 in the closed position relative to the container 206 can be of any suitable type. In the illustrated embodiment, the fastening means is a resilient loop 234 that is part of the lid 208 and that snaps over a corresponding raised tooth or protuberance 236 of the container 206 to releasably secure the lid 288 in the closed position. The loop 234 has a finger tab 235 to aid a user in opening the lid 208. When the lid 208 is open, the porous pad 202 can be accessed by the user so that the user can press the porous pad 202 with one or more of his or her fingers in order to wet or moisten his or her fingers. With the lid 208 in the open position, the reservoir 204 can also be accessed by the user so that the user can press the reservoir closure 220 with one or more of his or her fingers in order to transfer water from the reservoir 204 to the porous pad 202 in order to wet or moisten the porous pad 202 when needed.

As another option, a strap 210 can be provided for the container 206 to allow the moisture pad 200 to be worn on a person's body. The strap 210 can, for example, be a wrist strap or an upper arm strap. The strap 210 uses hook and loop fastener portions 224 and 226 that allow the strap 210 to be fastened on to itself after it has been routed through the ring or loop 228. One end of the strap 210 is placed around the loop 230 and attached to itself, such as by sewing, in order to attach the strap 210 to the housing or container 206, thus securing the strap 210 to the container 206. As an alternative, the strap 210 may be of a two-piece design that employs a buckle attached to one piece of the strap, which could again employ a hook-and-loop fastener system or the buckle could have one or more prongs that cooperate with perforations in the other piece of the strap to fasten the strap around the wearer's wrist or other body part.

The reservoir 204 is preferably provided with a closable filling opening 218 that is provided with a cap or closure 220. The cap 220 includes a central dome 222 and an annular flange 232 around the central dome 222. The outer diameter of the cap 220 is defined by the outer diameter of the flange 232 and is at least large enough to completely cover the filling opening 218. The central dome 222 has an outside diameter that is approximately the same as the inside diameter of the filling 218. The cap 220 also has a cylindrical sleeve 238 extending downward from the bottom of the assembly formed by the dome 222 and the flange 232 and into the filling opening 218. In the illustrated example, the cylindrical sleeve 238 has an outside diameter that is approximately the same as the inside diameter of the filling opening 218. In the illustrated example, the cylindrical sleeve 238 has an inside diameter that is approximately the same as the inside diameter of the dome 222. In the illustrated example, the cylindrical sleeve 238 is concentric with the dome 222 and the flange 232.

The cap 220 is preferably provided with fastening means to secure the cap 220 in the closed position. The filling opening 218 is in the form of a cylindrical passage and has an inner edge 242. When the cap 220 is engaged to the filling opening 218 so as to seal closed the filling opening 218, the sleeve 238 extends inward of the inner edge 242 of the filling opening 218 in the direction of the interior of the reservoir 204. The inner end portion of the sleeve 238 is provided with a raised annular ridge or protuberance 240, which engages the inner edge 242 of the filling opening 218 to secure the cap 220 in the closed position relative to the filling opening 218. The cap 220 seals and/or closes off the filling opening 218 when the cap 220 is in the closed position. The specific fastening means used is the illustrated embodiment is one example of suitable fastening means for releasably securing the cap 220 in the closed position. The fastening means for releasably securing the cap 220 in the closed position can also be of any other suitable type. When the cap 220 is open, i.e. removed from the filling opening 218 to leave the filling opening 218 in the open condition, the reservoir 204 can be filled with water or other suitable fluid.

The cap or closure 220 is made of a flexible and resilient material, the internal resilience or bias of which returns the closure 220 to its original shape after it has been deformed such as by applying pressure to the dome portion 222 or when removing or installing the closure 220 from or in the filling opening 218. The preferred materials for the closure 220 are rubber like materials including, for example, natural and synthetic rubbers.

The reservoir 204 is provided with at least a first passage 244 that allows water to move from the reservoir 204 to the porous pad compartment 216. The first passage 244 is provided in and extends through the wall 246 separating the reservoir 204 from the porous pad compartment 216. The reservoir 204 is provided with at least a second passage 248 that allows air to move from the porous pad compartment 216 to the reservoir 204. The second passage 248 is provided in and extends through the wall 246 separating the reservoir 204 from the porous pad compartment 216 at a location spaced apart from the first passage 244.

The first passage 244 is provided with a one-way valve 250 that controls fluid flow through the first passage 244 such that the valve 250 opens when the pressure in the reservoir 204 is higher than the pressure within the porous pad compartment 216 by at least some threshold amount. The valve 250 allows fluid flow from the reservoir 204 to the sponge or porous pad compartment 216, but prevents any appreciable fluid flow from the porous pad compartment 216 to the reservoir 204. As used herein, "appreciable fluid flow" means an amount of fluid that would impact the function of the moisture pad 200.

The second passage 248 is provided with a one-way valve 252 that controls fluid flow through the second passage 248 such that the valve 252 opens when the pressure in the reservoir 204 is lower than the pressure within the porous pad compartment 216 by at least some threshold amount. The valve 252 allows air flow from the sponge or porous pad compartment 216 to the reservoir 204, but prevents any appreciable fluid flow, such that it would impact the function of the moisture pad 200, from the reservoir 204 to the porous pad compartment 216. When the lid 208 is open, the porous pad compartment 216 communicates with the ambient atmosphere, which allows ambient air to be supplied to the reservoir 204 through the porous pad compartment 216 and the valve 252 when needed.

The reservoir 204 is provided with the one-way valve 250 that allows water to be dispensed to the porous pad 202 when the flexible closure 220, and in particular the dome portion 222, is pressed to squeeze or compress and thus pressurize the air and water within the reservoir 204. The one-way valve 250 is normally closed to prevent water loss from the reservoir 204. The user can press the flexible closure 220 to pressurize the contents of the reservoir 204 and thus open the one-way valve 250 to allow water to be applied to the porous pad 202 as necessary to wet the pad 202 when desired. The second one-way valve 252 allows air to enter the reservoir 204 from the porous pad compartment 216 in order to prevent formation of a vacuum in the reservoir 204 and thus ensure unhindered flow of water from the reservoir 204 to the porous pad compartment 216 when the flexible closure 220 is pressed.

The one-way valves 250 and 252, can be of any suitable type such as, for example, a caged ball one-way valve; a spring biased, caged ball one-way valve; or a flexible flap one-way valve of some molded, flexible, and resilient material, which can be selected from suitable rubber like materials including, for example, natural and synthetic rubbers, that is self-biased or internally biased to assume the closed configuration. In the illustrated example, a type of flexible flap one-way valve of molded rubber referred to as an umbrella valve is used.

Referring to FIGS. 17-27, the first passage 244 is in the form of one or more perforations 254 arranged along a circumference of a circle centered at about the location of the first passage 244. An opening 256 is provided concentric with the circle, about which the perforations 254 are arranged. The umbrella valve 250 has a stem 258 and a parasol or cap 260. The stem 258 is positioned to extend through the center hole 256, while the parasol 260 is positioned over the perforations 254 on the porous pad compartment side of the dividing wall 246. A bulge 262 formed on the stem 258 holds the umbrella valve 250 in place. In the closed configuration the parasol 260 contacts the wall 246 at least around the perforations 254 to effectively seal or close off the perforations 254 so that no fluid can flow through the perforations 254. Accordingly, the umbrella valve 250 prevents fluid flow from the reservoir 204 to the porous pad compartment 216 when it is in the closed configuration.

When the pressure in the reservoir 204 exceeds the pressure in the porous pad compartment 216 by at least the threshold amount, the parasol 260 is lifted away from the dividing wall 246 so as to allow fluid from the reservoir 204 to flow through the perforations 254 and into the porous pad compartment 216. When the pressure in the reservoir 204 exceeds the pressure in the porous pad compartment 216 by an amount less than the threshold amount, the parasol 260 returns to its closed configuration, where the parasol 260 contacts the wall 246 to cover and seal off the perforations 254 so that no fluid can flow through the perforations 254, due to the internal resilience or bias of the umbrella valve 250. When the pressure in the reservoir 204 is equal to or less than the pressure in the porous pad compartment 216, the parasol 260 is maintained in the closed configuration, and no fluid can flow through the perforations 254 and from the reservoir 204 to the porous pad compartment 216. Accordingly, the umbrella valve 250 only permits one-way fluid flow from the reservoir 204 to the porous pad compartment 216 and only when the pressure in the reservoir 204 exceeds the pressure in the porous pad compartment 216 by at least the threshold amount.

Referring to FIGS. 17-27, the second passage 248 is in the form of one or more perforations 264 arranged along a circumference of a circle centered at about the location of the second passage 248. An opening 266 is provided concentric with the circle, about which the perforations 264 are arranged. The umbrella valve 252 has a stem 268 and a parasol or cap 270. The stem 268 is positioned to extend through the center hole 266, while the parasol 260 is positioned over the perforations 264 on the reservoir side of the dividing wall 246. A bulge 272 formed on the stem 268 holds the umbrella valve 252 in place. In the closed configuration the parasol 270 contacts the wall 246 at least around the perforations 264 to effectively seal or close off the perforations 264 so that no fluid can flow through the perforations 264. Accordingly, the umbrella valve 252 prevents fluid flow from the porous pad compartment 216 to the reservoir 204 when it is in the closed configuration.

When the pressure in the reservoir 204 drops below the pressure in the porous pad compartment 216 by at least the threshold amount, the parasol 270 is lifted away from the dividing wall 246 so as to allow air from the porous pad compartment 216 to flow through the perforations 264 and into the reservoir 204. When the pressure in the reservoir 204 is below the pressure in the porous pad compartment 216 by an amount less than the threshold amount, the parasol 270 returns to its closed configuration, where the parasol 270 contacts the wall 246 to cover and seal off the perforations 264 so that no fluid can flow through the perforations 264, due to the internal resilience or bias of the umbrella valve 252. When the pressure in the reservoir 204 is equal to or greater than the pressure in the porous pad compartment 216, the parasol 270 is maintained in the closed configuration, and no fluid can flow through the perforations 264 and from the porous pad compartment 216 to the reservoir 204. Accordingly, the umbrella valve 252 only permits one-way fluid flow from the porous pad compartment 216 to the reservoir 204 and only when the pressure in the reservoir 204 drops below the pressure in the porous pad compartment 216 by at least the threshold amount.

In the illustrated example, the flexible closure or cap 220 and the one-way valves 250 and 252 constitute the pump means for transferring water or fluid from the reservoir to the sponge or porous pad or to the compartment housing the sponge or porous pad. In the illustrated example, the flexible closure or cap 220 constitutes pressurizing means for pressurizing the contents of the reservoir 204. Other suitable pressurizing means include, for example, relatively rigid closures that are snap fit or screwed to the filling opening and incorporate a diaphragm or a spring biased piston and cylinder arrangement for pressurizing the contents of the reservoir. The parasol of each of the one-way valves 250 and 252 constitutes the flexible flap of each of these umbrella valves. The portion of the closure 220 for covering the filling opening 218 includes the central dome 222 and the annular flange 232, which surrounds the dome 222. The dome 222 can be pressed inward toward the reservoir 204 in order to pressurize the reservoir 204.

In the illustrated example, a tongue 274 that is coextensive with and defines the lower rim of the lid 208 fits inside a groove 276 provided along and in proximity to the top perimeter of the container 206 when the lid 208 is in the closed position. A sealing gasket 278 is provided inside the groove 276 that is contacted by the tongue 274 so as to form a seal between the lid 208 and the container 206 when the lid 208 is in the closed position in order to prevent evaporative water loss and/or leakage of water when the moisture pad 200 is not being used for moistening tasks.

It is to be understood that the present invention is not limited to the embodiments described above, but encompasses any and all embodiments within the scope of the following claims.

The invention claimed is:

1. A moisture pad comprising:

a container divided into a reservoir and a porous pad compartment, said reservoir having a filling opening, said reservoir being capable of having a pressure therein, and said porous pad compartment being capable of having a pressure therein;

a closure for said filling opening, said closure incorporating means for pressurizing said reservoir;

a porous pad for holding a quantity of absorbed water, said porous pad being housed in said porous pad compartment, said porous pad wetting one or more of a user's fingers with a portion of a quantity of water absorbed therein when said porous pad having said quantity of water absorbed therein is pressed by the one or more of the user's fingers; and at least a first one-way valve that opens when the pressure in said reservoir is higher than the pressure within said porous pad compartment by at least some threshold amount and allows fluid flow from said reservoir to said porous pad compartment, wherein said reservoir is capable of holding a quantity of water, wherein water from said reservoir can be used for wetting said porous pad under the control of the user, wherein said porous pad compartment has a top opening for allowing access to said porous pad, and wherein said closure is flexible and resilient and can be pressed inward by the user to pressurize said reservoir such that water from said reservoir wets said porous pad when said closure is pressed inward by the user while said reservoir holds at least a predetermined quantity of water.

2. The moisture pad according to claim 1, further comprising a strap for holding the moisture pad on a person's body.

3. The moisture pad according to claim 1, further comprising at least a second one-way valve for allowing air to enter said reservoir so as to prevent the creation of a vacuum inside said reservoir.

4. The moisture pad according to claim 3, wherein said second one-way valve allows air flow from said porous pad compartment to said reservoir when said second one-way valve is open.

5. The moisture pad according to claim 4, further comprising a wall separating said reservoir from said porous pad compartment, said wall having at least a first passage that allows water to move from said reservoir to said porous pad compartment, wherein said first passage is provided with said first one-way valve, and wherein said first one-way valve controls fluid flow through said first passage.

6. The moisture pad according to claim 5, wherein said wall has at least a second passage that allows air to move from said porous pad compartment to said reservoir, wherein said second passage is provided with said second one-way valve, and wherein said second one-way valve controls fluid flow through said second passage.

7. The moisture pad according to claim 1, further comprising a closure for said container that covers said top opening for allowing access to said porous pad when said closure for said container is in a closed position.

8. The moisture pad according to claim 1, further comprising a wall separating said reservoir from said porous pad compartment, said wall having at least a first passage that allows water to move from said reservoir to said porous pad compartment, wherein said first passage is provided with said first one-way valve, and wherein said first one-way valve controls fluid flow through said first passage.

9. The moisture pad according to claim 1, wherein said first one-way valve prevents water loss from the reservoir when it is closed.

10. A moisture pad comprising:

a container divided into a reservoir and a porous pad compartment, said reservoir having a filling opening;

a closure for said filling opening, said closure incorporating means for pressurizing said reservoir; and a porous pad for holding a quantity of absorbed water, said porous pad being housed in said porous pad compartment, said porous pad wetting one or more of a user's fingers with a portion of a quantity of water absorbed therein when said porous pad having said quantity of water absorbed therein is pressed by the one or more of the user's fingers, wherein said reservoir is capable of holding a quantity of water, wherein water from said reservoir can be used for wetting said porous pad under the control of the user, wherein said porous pad compartment has a top opening for allowing access to said porous pad, wherein said closure is flexible and resilient and can be pressed inward by the user to pressurize said reservoir such that water from said reservoir wets said porous pad when said closure is pressed inward by the user while said reservoir holds at least a predetermined quantity of water, and wherein said closure has a portion for covering said filling opening, a cylindrical sleeve, and an annular protuberance, wherein said annular protuberance is attached to an end portion of said cylindrical sleeve that is distally located from said portion for covering said filling opening, and wherein when said closure is secured to said filling opening in the closed position, said cylindrical sleeve extends into said filling opening and said annular protuberance engages an inner edge of said filling opening to secure said closure to said filling opening in said closed position.

11. The moisture pad according to claim 10, wherein said portion for covering said filling opening comprises a central dome surrounded by an annular flange, wherein said dome can be pressed inward toward said reservoir in order to pressurize said reservoir.

12. The moisture pad according to claim 11, further comprising at least a first one-way valve for controlling water flow to said porous pad compartment.

13. The moisture pad according to claim 12, further comprising at least a second one-way valve for allowing air to enter said reservoir so as to prevent the creation of a vacuum inside said reservoir.

14. The moisture pad according to claim 13, wherein said first one-way valve and said second one-way valve are umbrella valves.

15. The moisture pad according to claim 13, further comprising a strap for holding the moisture pad on a person's body.

16. The moisture pad according to claim 15, further comprising a closure for said container that covers said top opening for allowing access to said porous pad when said closure for said container is in a closed position.

17. The moisture pad according to claim 16, wherein said first one-way valve and said second one-way valve are umbrella valves.

18. The moisture pad according to claim 12, wherein said first one-way valve is an umbrella valve.

* * * * *